US005237719A

United States Patent [19]

Dwyer, Jr. et al.

[11] Patent Number: 5,237,719

[45] Date of Patent: Aug. 24, 1993

[54] CLEANING APPARATUS

[75] Inventors: Donald J. Dwyer, Jr.; Jesse G. Head, both of Waco, Tex.

[73] Assignee: Donald J. Dwyer, Sr., Waco, Tex.

[21] Appl. No.: 778,494

[22] Filed: Oct. 17, 1991

[51] Int. Cl.[5] ..... A47L 11/34

[52] U.S. Cl. ..... 15/321; 15/320; 15/353; 15/410

[58] Field of Search ..... 15/320, 321, 353, 410

[56] References Cited

U.S. PATENT DOCUMENTS

| | | | |
|---|---|---|---|
| 3,262,146 | 7/1966 | Hays | 15/321 |
| 3,821,830 | 7/1974 | Sundheim | 15/321 |
| 3,896,521 | 7/1975 | Parise | 15/321 |
| 4,314,385 | 2/1982 | Wimsatt et al. | 15/321 |
| 4,367,565 | 1/1983 | Parise | 15/321 |
| 4,466,155 | 8/1984 | Grave | 15/321 |
| 4,488,330 | 12/1984 | Grave | 15/322 |
| 4,542,556 | 9/1985 | Hepple | 75/321 |
| 4,724,573 | 2/1988 | Ostergaard | 15/321 |
| 4,800,615 | 1/1989 | Ostroski et al. | 15/353 |
| 4,803,466 | 2/1989 | Gurstein et al. | 15/319 X |
| 4,809,397 | 3/1989 | Jacobs et al. | 15/321 X |
| 4,821,367 | 4/1989 | McAllister et al. | 15/353 |
| 4,864,680 | 9/1989 | Blase et al. | 15/321 |
| 5,146,647 | 9/1992 | Blase et al. | 15/321 |

OTHER PUBLICATIONS

Advertising brochure on "The Ultimate" cleaning machine, published by U.S. Products, Inc., of Hayden Lake, Idaho, date unknown.

*Primary Examiner*—Chris K. Moore
*Attorney, Agent, or Firm*—W. Kirk McCord

[57] ABSTRACT

An improved cleaning apparatus for cleaning carpet, upholstery and the like includes a housing, a first storage tank removably carried in the housing for storing a liquid cleaning solution, a dispensing pump for dispensing the cleaning solution to an area to be cleaned, a vacuum motor for suctioning excess cleaning solution and other material extracted from the area, and a second storage tank removably carried in the housing for accumulating excess cleaning fluid and other material extracted from the area. Respective upper portions of the first and second storage tanks extend above the housing when the first and second storage tanks are carried therein. The first and second storage tanks are each equipped with a pair of handles to facilitate removal and replacement of the respective tanks. A quick disconnect fitting is provided for locating the first storage tank so that the first storage tank is in fluid communication with the dispensing pump. The quick disconnect fitting enables rapid removal of the first storage tank from the housing and facilitates reinstallation thereof.

15 Claims, 3 Drawing Sheets

CLEANING APPARATUS

FIELD OF INVENTION

This invention relates generally to cleaning apparatus in and particular to improvements in cleaning apparatus, including carpet cleaners.

BACKGROUND OF THE INVENTION

When carpets of synthetic fiber were introduced to the public after World War II, attractive-wall-to-wall carpet became the standard in American homes. The long life of synthetic fiber carpets has resulted in the development of the business of professional carpet cleaning and maintenance.

The carpet maintenance industry at first adopted the tools and machines of the janitorial service business. Thereafter, manufacturers began to provide modified floor buffers and vacuum cleaners and new and better chemicals for use in carpet cleaning.

DESCRIPTION OF THE PRIOR ART

The first generation of carpet cleaners typically used steam to remove dirt from the carpet fibers A major problem associated with the so-called "steam cleaners" is that a source of steam is required Truck-mounted equipment was often used to generate the steam. Another problem associated with "steam cleaners" is that the steam may generate excessive heat, which can damage carpet fibers.

More recent developments in carpet cleaning apparatus have included a new generation of high-power and portable machines. These machines typically dispense a cleaning solution and include means for agitating the cleaning solution and for vacuuming up excess cleaning solution and other waste material extracted from the carpet. Separate receptacles are required for storing the cleaning solution and for accumulating the waste material extracted from the carpet. Refilling the cleaning solution receptacle and emptying the waste material receptacle are cumbersome procedures because the receptacles are usually not removable from the main housing of the machine.

Apparatus for cleaning, vacuuming and dyeing carpets are also known in the art. One such apparatus is disclosed in U.S. Pat. No. 4,542,556.

DISCLOSURE OF THE INVENTION

In accordance with the present invention, a cleaning apparatus is comprised of a housing, first storage means carried in the housing for storing a cleaning liquid, means for dispensing the cleaning liquid to the area to be cleaned, means for suctioning material from the area and second storage means for accumulating material suctioned from the area. In accordance with a unique feature of the invention, both the first and second storage means are removable from the housing.

In one embodiment, the first and second storage means are comprised of respective first and second storage tanks, which are locatable within the housing such that respective portions of the first and second storage tanks extend above the housing. In accordance with yet another feature of the invention, the first and second storage tanks have respective first and second cover members. The first storage tank further includes respective first and second handles. The second storage tank further includes respective third and fourth handles. The first cover member has opposed first and second structural members protruding therefrom and the second cover member has opposed third and fourth structural members protruding therefrom.

The first and second structural members have respective first and second seating surfaces sloping downwardly and away from the first cover member for urging the first and second handles into pressure engagement with the respective first and second structural members when the first and second handles are moved upwardly along the respective first and second seating surfaces, thereby retaining the first cover member in a closed position. The third and fourth structural members have respective third and fourth seating surfaces sloping downwardly and away from the second cover member for urging the third and fourth handles into pressure engagement with the respective third and fourth structural members when the third and fourth handles are moved upwardly along the respective third and fourth seating surfaces, thereby retaining the second cover member in a closed position. The first and second handles are disengageable from the respective first and second structural members by moving the first and second handles downwardly along the respective first and second seating surfaces, thereby allowing the first cover member to be removed from the first storage tank. The third and fourth handles are disengageable from the respective third and fourth structural members by moving the third and fourth handles downwardly along the respective third and fourth seating surfaces, to allow the second cover member to be removed from the second storage tank.

In accordance with yet another unique feature of the invention, the first and second storage tanks have respective first and second bottom recesses and the housing has first and second raised portions on a bottom surface thereof, which are adapted to matingly engage the respective first and second recesses for locating the respective first and second storage tanks within the housing.

In accordance still another unique feature of the invention, means is provided for locating the dispensing means in the housing. The locating means includes a base member secured to the dispensing means and a plurality of mounting members projecting upwardly from the bottom surface of the housing. The mounting members have respective pins defining respective top portions of the mounting members. The base member has a plurality of apertures adapted to receive the respective pins. Respective lower portions of the mounting members are enlarged relative to the respective pins to define respective support surfaces for supporting the base member when the pins are received within the respective apertures.

In accordance with yet another feature of the invention, the second storage tank includes partition means for dividing an interior portion of the second storage tank into first and second chambers. The suction means includes vacuum means for drawing air from the second storage tank to maintain a vacuum therein. The vacuum operates to draw material extracted from the carpet into the second chamber. The partition means substantially inhibits the material from penetrating into the first chamber, thereby substantially inhibiting the material from being sucked into the vacuum means. Conduit means is positioned in fluid communication between the second chamber and vacuum means. The apparatus further includes means for interrupting the fluid communication between the second chamber and vacuum means when a level of liquid within the second storage means reaches a predetermined maximum level. The interrupting means includes a buoyant member adapted to substantially block the conduit means when the level of liquid reaches the predetermined maximum level.

In the preferred embodiment, the apparatus is used for cleaning carpet, upholstery and the like. Connecting means is provided having a male member projecting upwardly from the housing and a female member depending downwardly from an external surface of the first storage tank. The female member is adapted for mating engagement with the male member when the first storage tank is located in the housing. First conduit means is located in the first storage tank and is coupled to the female member. Second conduit means is located outside the first storage tank and is coupled to the male member. The mating engagement between the male and female members effects fluid communication between the first and second conduit means.

The connecting means preferably further includes a locking ring for normally retaining the male and female members in mating engagement. The locking ring is manually operable for releasing the male member to be disengaged from the female member. The dispensing means preferably includes a pump for suctioning cleaning liquid from the first storage tank through the first and second conduit means and for discharging the cleaning liquid to be dispensed to the carpet.

The housing preferably further includes a discharge port for discharging air suctioned from the second storage tank to the exterior of the housing. The air discharged through the port is heated in the vacuum means to a temperature greater than the temperature of the air in the second storage tank.

The preferred embodiment of the invention further includes means for securing the dispensing means in a fixed position in the housing. The securing means includes a flexible strap attached to a bottom surface of the housing intermediate opposed first and second ends of the strap such that the first and second ends of the strap are free ends. The strap further includes complementary first and second attachment members located adjacent the respective first and second ends. The strap is adapted to be wrapped around the dispensing means and to be secured by the engagement of the first and second attachment members. In the preferred embodiment, the first and second attachment members are complementary hook and loop fasteners.

DETAILED DESCRIPTION OF THE PREFERRED EMBODIMENT

Figure 1:
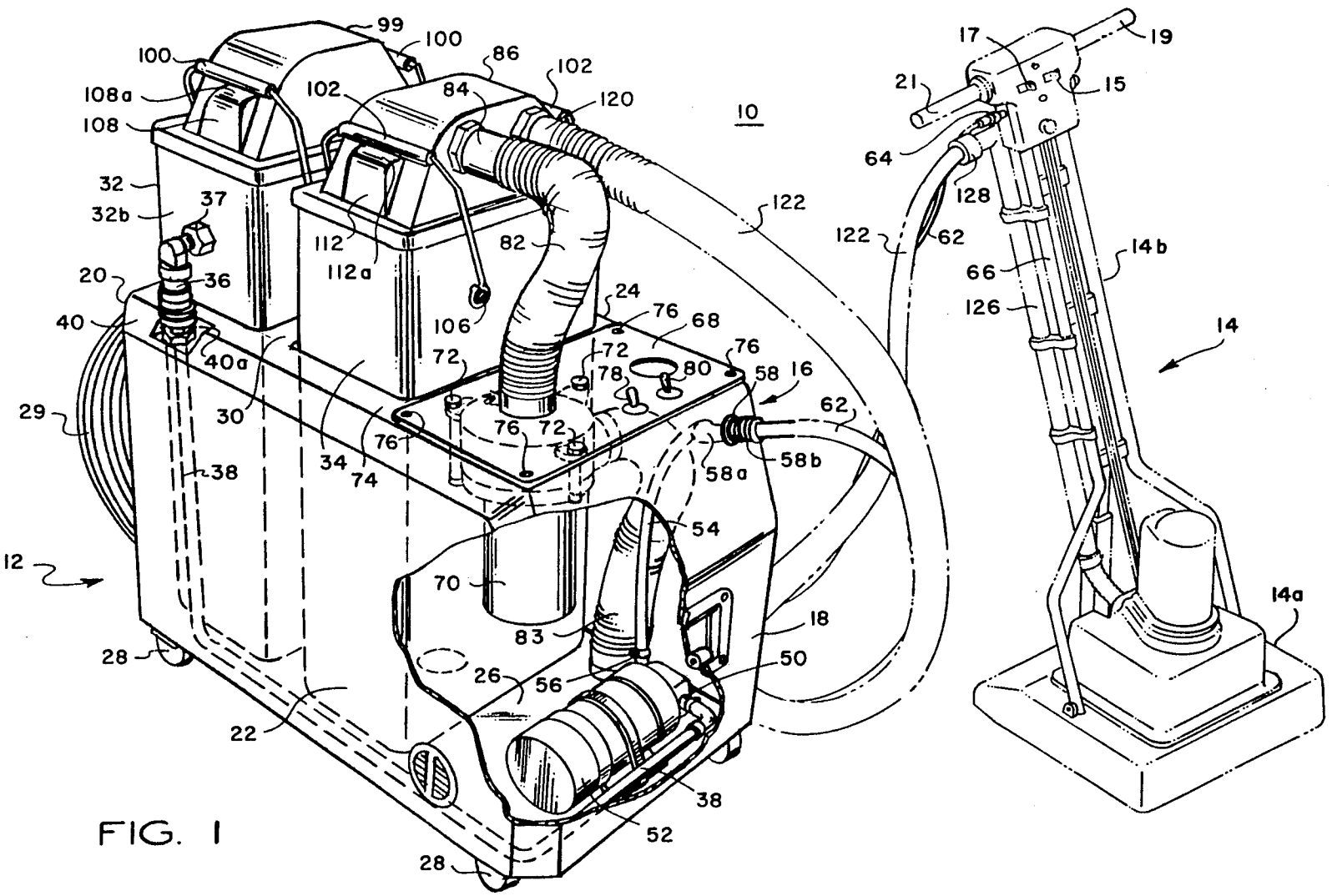
FIG. 1 is a perspective view of a cleaning apparatus, according to the present invention, with a portion of the housing broken away.

In the description which follows, like parts are marked throughout the specification and drawings with the same respective reference numerals. The drawings are not necessarily to scale and in some instances proportions may have been exaggerated in order to more clearly depict certain features of the invention.

Referring now to FIG. 1, there is shown a preferred embodiment of a cleaning apparatus 10, which is comprised of a powerbase unit 12 and a powerhead unit 14. Cleaning apparatus 10 is adaptable for a variety of cleaning operations, such as cleaning carpet and upholstery. The preferred embodiment of the invention will be described with respect to cleaning carpet. Powerbase unit 12 houses the vacuum and cleaning fluid dispensing systems, and associated electrical circuitry, as will be discussed in greater detail hereinafter. Powerhead unit 14 includes a base portion **14*a* in which various brushes and spray manifolds are carried and an upstanding portion 14*b*, which includes user operable switches 15 and 17 and opposed handles 19 and 21**.

Powerbase unit 12 includes a generally box shaped housing 16 having upstanding front, rear, right side and left side walls 18, 20, 22 and 24, respectively. Housing 16 further includes a relatively flat base plate 26 and a substantially open top. Housing 16 is preferably integrally formed from a lightweight plastic material. Four wheels 28 (three of which are shown in FIG. 1) are mounted on an undersurface of base plate 26, adjacent the four corners of housing 16, to permit powerbase unit 12 to be rolled over a surface, such as a carpeted floor. Wheels 28 are mounted for swiveling movement about respective axes perpendicular to base plate 26, to facilitate turning movements of powerbase unit 12. An electrical cord 29 is provided with an end plug for connecting powerbase unit 12 to a source of electrical power, such as an AC electrical outlet.

Figure 2:
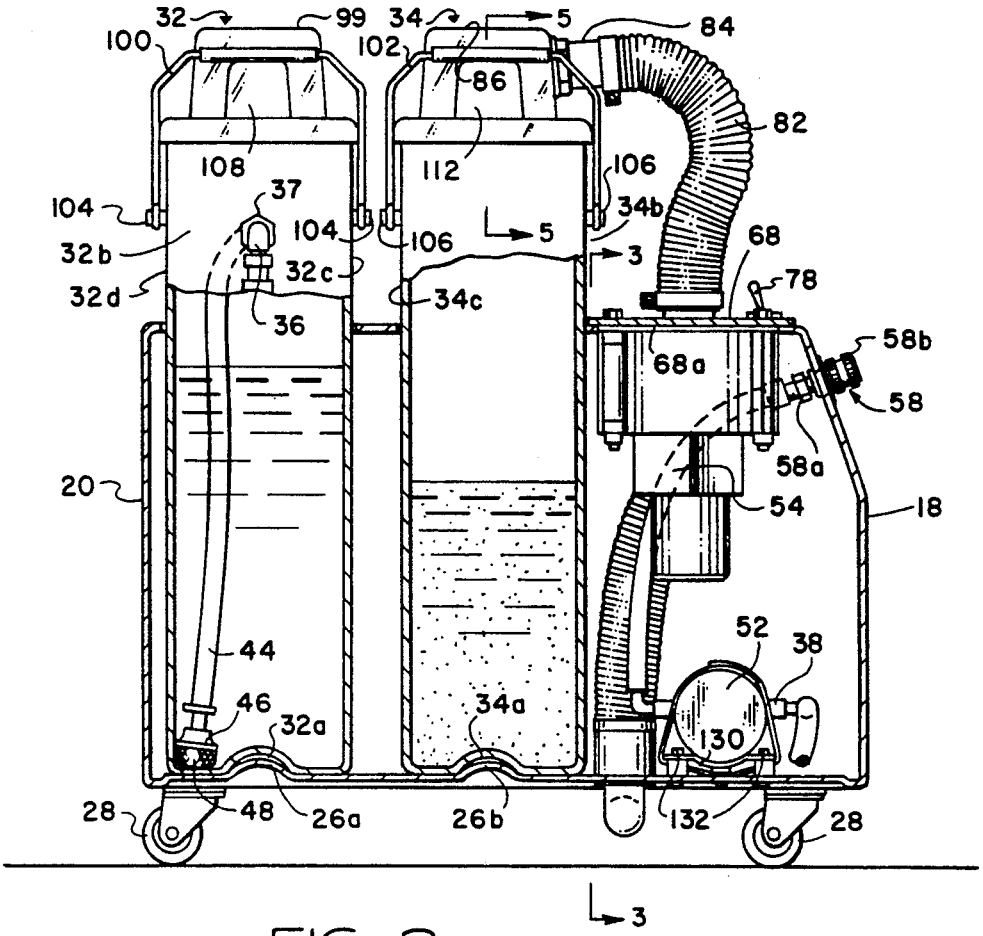
FIG. 2 is a right side elevation view of the cleaning apparatus of FIG. 1, with a portion of the right side of the housing broken away.

Referring also to FIG. 2, the interior of housing 16 defines a chamber in which various components of powerbase unit 12 are carried. The open top is punctuated by a strip 30, which defines first and second openings at the top of housing 16. The first opening is adapted to receive a generally rectangular first storage tank 32 and the second opening is adapted to receive a generally rectangular second storage tank 34. First storage tank 32 serves as a receptacle for storing a liquid cleaning solution, while second storage tank 34 functions as a waste storage tank for storing excess cleaning solution and other waste material extracted from the carpet.

In accordance with a unique feature of the invention, first and second storage tanks 32 and 34 are removably carried in housing 16, to facilitate cleaning of both tanks 32 and 34 and also to facilitate refilling of first storage tank 32 with a fresh supply of cleaning solution and emptying second storage tank 34 when tank 34 is full or near full. Respective upper portions of first and second storage tanks 32 and 34 extend above the top of housing 16, to facilitate removal of tanks 32 and 34.

In accordance with another unique feature of the invention, first and second storage tanks 32 and 34 have respective bottom recesses **32*a* and 34*a*. Recesses 32*a* and 34*a* are adapted to receive respective raised portions 26*a* and 26*b* of base plate 26, as can be best seen in FIG. 2. Recess 32*a* and raised portion 26*a* cooperate to locate first storage tank 32 in a substantially vertical position within housing 16. Recess 34***a* and raised portion 26*b* cooperate to locate second storage tank 34 in a substantially vertical position within housing 16. This "self-aligning" feature allows first and second storage tanks 32 and 34 to be quickly and conveniently located within housing 16.

Figure 6:
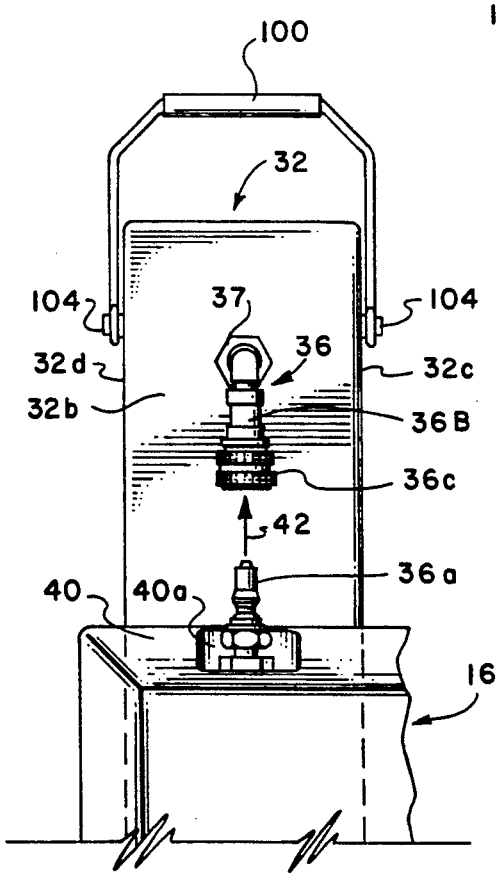
FIG. 6 is a partial right side elevation view of the cleaning apparatus of FIG. 1.

In accordance with yet another unique feature of the invention, as can be best seen in FIG. 2 and FIG. 6, a "quick disconnect" fitting 36 is provided for coupling first storage tank 32 to a first suction conduit 38, which is preferably comprised of a flexible hose. Conduit 38 is located inside housing 16, but external to tank 32. Fitting 36 includes a male member 36*a* extending upwardly from a recessed portion 40*a* of a beveled upper side surface 40 of housing 16 and a female member 36*b* depending from a right side exterior wall 32*b* of first storage tank 32. Female member 36*b* is adapted for mating engagement with male member 36*a* when first storage tank 32 is carried in housing 16. Female member 36*b* includes a plurality of gripping elements (not shown), which are actuated by a spring-biased locking ring 36*c* for retaining male member 36*a* in mating engagement with female member 36*b*. Male member 36*a* and female member 36*b* remain in mating engagement until they are released by moving locking ring 36*c* upwardly (i.e., in the direction of arrow 42), as can be best seen in FIG. 6. The upward movement of locking ring 36*c* releases the gripping elements to allow female member 36*b* to be disengaged from male member 36*a*. Locking ring 36*c* is spring-biased downwardly (i.e., in a direction opposite from arrow 42) for normally actuating the gripping elements to retain male member 36*a* in mating engagement with female member 36*b*. When first storage tank 32 is fully inserted into housing 16 such that recess 32*a* is in mating engagement with raised portion 26*a*, female member 36*b* is in mating engagement with male member 36*a*, to couple first storage tank 32 to conduit 38.

As can be best seen in FIG. 2, a second suction conduit 44, which is preferably comprised of a flexible hose, is located inside tank 32 and is connected to female member 36*b* by means of a connector fitting 37. Conduit 44 has a suction head 46 positioned at or adjacent the bottom of first storage tank 32. Suction head 46 includes a relatively fine mesh wire screen 48, to inhibit solid material from being sucked into conduit 44.

When male member 36*a* and female member 36*b* are in mating engagement, conduit 38 is in fluid communication with conduit 44. Conduit 38 is adapted to conduct liquid cleaning solution from first storage tank 32 to a suction side 50 of a cleaning fluid dispensing pump 52. Pump 52 sucks the cleaning solution from tank 32 through conduit 38 and discharges the cleaning solution through a discharge conduit 54. Conduit 54 is coupled between a discharge side 56 of pump 52 and an interior portion 58*a* of a second quick disconnect fitting 58. Exterior portion 58*b* of fitting 58 includes a female member, which is adapted to receive a complementary male member (not shown) attached to the end of an external dispensing hose 62, such that hose 62 is in fluid communication with discharge conduit 54. Powerhead unit 14 preferably includes a third quick disconnect fitting 64 for coupling dispensing hose 62 to powerhead unit 14. The cleaning solution is conducted via tubular conduit 66 to base portion 14*a* of powerhead unit 14, where the cleaning solution is applied to the carpet.

Figure 3:
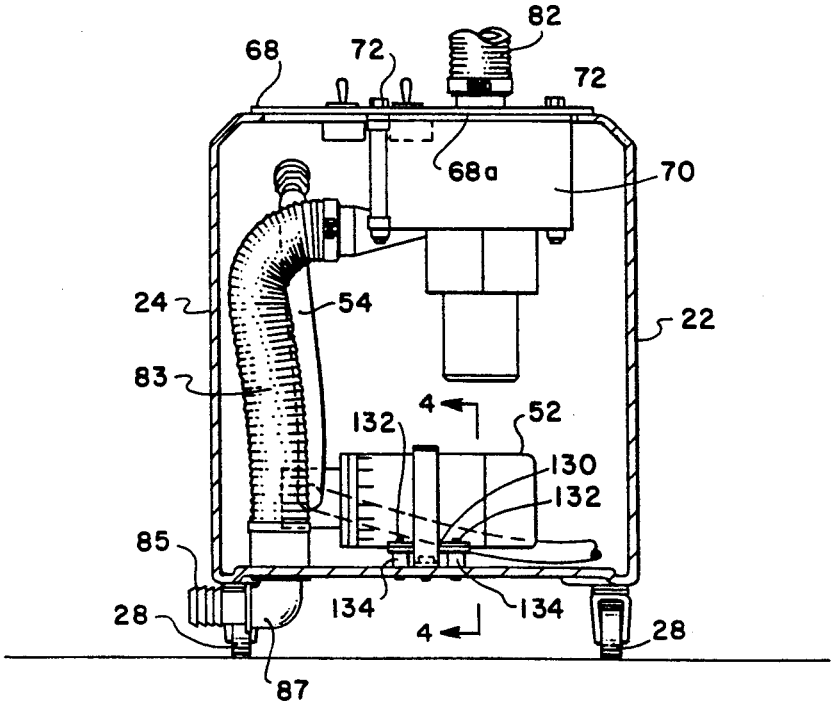
FIG. 3 is a sectional view, taken along the line 3—3 of FIG. 2.

Referring now to FIGS. 1–3, a relatively flat metal cover plate 68 is secured to the top of housing 16 so that cover plate 68 closes of a portion of the second opening. A vacuum motor 70 is mounted on a lower surface 68*a* of cover plate 68. Vacuum motor 70 is preferably attached to cover plate 68 by means of three mounting bolts 72. Cover plate 68 is secured to a top rim 74 of housing 16 by means of four mounting screws 76. Dispensing pump 52 is mounted on base plate 26 substantially directly below cover plate 68 such that access to dispensing pump 52 is facilitated by removal of cover plate 68. Removing cover plate 68 also allows ready access to vacuum motor 70, as well as to the various electronic components (not shown) carried inside housing 16. Manually operable switches 78 and 80 are mounted on the outside of cover plate 68 for ready access. Switch 78 is an "on-off" switch for controlling the operation of vacuum motor 70 and switch 80 is an "on-off" switch for controlling the operation of dispensing pump 52.

Referring now to FIG.,s 1, 2, 3 and 5, vacuum motor 70 operates to suction air out of second storage tank 34, to create a vacuum therein. Air is sucked from second storage tank 34 via a flexible hose 82, which is coupled to a translucent, removable cover member 86 on top of second storage tank 34 by means of an external male fitting 84 protruding from cover member 86. Air sucked from second storage tank 34 is discharged to the atmosphere by vacuum pump 70 via discharge hose 83 and an outlet port 85 below left side wall 24. Duct 85 is coupled to hose 83 by means of a swivelable connector fitting 87, to allow duct 85 to be swiveled so as to change the direction in which air is discharged therefrom. Air is heated as it passes through vacuum pump 70 so that air is discharged from duct 85 at a higher temperature than the air temperature in second storage tank 34. A hose or other conduit (not shown) can be attached to duct 85 to direct the warm air to a particular area of the carpet which has been cleaned to facilitate drying the carpet.

Figure 5:
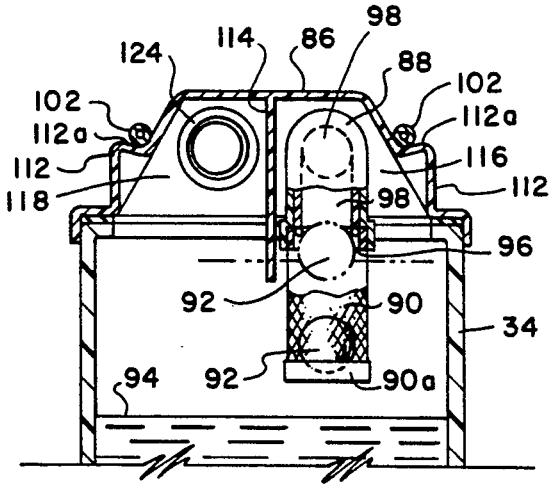
FIG. 5 is a sectional view; taken along the line 5—5 of FIG. 2.

Male fitting 84 is coupled to an elbow fitting 88 inside cover member 86. A relatively coarse mesh screen basket 90 depends downwardly from elbow fitting 88, as can be best seen in FIG. 5. A ball member 92 is disposed in basket 90 and is normally carried in the bottom portion 90*a* of basket 90. Basket 90 filters out solid material, to inhibit such solid material from being sucked into vacuum motor 70. Ball member 92 functions as a float mechanism to prevent the waste liquid in second storage tank 34 from being sucked into vacuum motor 70. In FIG. 5, the waste liquid level is indicated by reference number 94, which is below bottom portion 90*a* of basket 90. When the waste liquid is at the level indicated in FIG. 5, ball member 92 remains in bottom portion 90*a*. If, however, the waste liquid level rises above bottom portion 90*a*, waste liquid will flood into basket 90 and ball member 92 will float upwardly along with the rising waste liquid until the waste liquid level reaches the level indicated by reference number 97, whereupon ball member 92 engages a seat 96 within elbow fitting 88 to close off passageway 98, thereby interrupting the fluid communication between hose 82 and tank 34 and inhibiting waste liquid from being sucked into vacuum motor 70.

One skilled in the art will appreciate that ball member 92 cooperates with seat 96 to provide a closure valve, for closing off passageway 98 when the waste liquid level reaches the level indicated by reference number 97. Vacuum motor 70 includes a device for automatically disabling vacuum motor 70 in response to the interruption of the suction air flow through hose 82.

Referring now to FIG.,s 1, 2 and 6, first storage tank 32 has a translucent, removable cover member 99. First storage tank 32 further includes a first pair of handles 100 to facilitate removal and reinstallation of first storage tank 32. Similarly, second storage tank 34 is equipped with a second pair of handles 102 to facilitate the removal and reinstallation of second storage tank 34. Each one of the first pair of handles 100 is attached at respective opposite ends thereof to respective attachment pins 104 protruding from respective external front and rear walls 32*c* and 32*d* of first storage tank 32. Each one of the second pair of handles 102 is attached at respective opposite ends thereof to respective second attachment pins 106 protruding from respective external front and rear walls 34*b* and 34*c* of second storage tank 34.

Cover member 99 includes a pair of substantially rectangular structural members 108 protruding from respective opposite sides thereof. Each structural member 108 includes an upper seating surface 108*a* sloping downwardly and away from cover member 99 for engaging a corresponding handle 100, as shown in FIG. 1. Each seating surface 108*a* urges the corresponding handle 100 into pressure engagement with the corresponding structural member 108 when the corresponding handle 108 is moved inwardly and upwardly along the corresponding seating surface 108*a*, to retain cover member 99 in a closed position. To remove cover member 99, handles 100 are moved outwardly and downwardly along the respective seating surfaces 108*a* until disengaged therefrom, whereupon cover member 99 is removable from first storage tank 32. When cover member 99 is removed, handles 100 can be grasped to facilitate the removal of first storage tank 32 from housing 16. With cover member 99 removed, the interior of first storage tank 32 is accessible, which allows tank 32 to be cleaned and/or refilled.

Cover member 86 has a pair of substantially rectangular structural members 112 on respective opposite sides thereof. Each structural member 112 has an upper seating surface 112*a* sloping downwardly and away from cover member 86 for engaging a corresponding handle 102, as shown in FIG. 1. Each seating surface 112*a* urges the corresponding handle 102 into pressure engagement with the corresponding structural member 112 when the corresponding handle 102 is moved inwardly and upwardly along the corresponding seating surface 112*a*, to retain cover member 86 in a closed position. To remove cover member 86, handles 102 are moved outwardly and downwardly along the respective seating surfaces 112*a* until disengaged therefrom, whereupon cover member 86 is removable from second storage tank 34. When cover member 86 is removed, handles 102 can be grasped to facilitate removal of second storage tank 34 from housing 16. When cover member 86 is removed, access is available to the interior of second storage tank 34, to allow tank 34 to be emptied and/or cleaned.

Referring now to FIG.,s 1, 2 and 5, the interior portion of cover member 86 includes a partition 114, which divides the interior of cover member 110 into respective first and second chambers 116 and 118. Elbow fitting 88 and basket 90 are located in first chamber 116. Cover member 86 has a second exterior male fitting 120, which is adapted for mating engagement with a flexible hose 122. Male fitting 120 is connected to a discharge fitting 124, which is located in second chamber 118. The vacuum maintained in second storage tank 34 by vacuum pump 70 sucks waste liquid from base portion 14*a*, upwardly through tubular conduit 126 and hose 122 and into second storage tank 34. Partition 114 inhibits liquid and other material entering second chamber 118 through fitting 124 from penetrating into first chamber 116, thereby substantially preventing waste material from being sucked into vacuum motor 70. Hose 122 is preferably connected to upstanding portion 14*b* of powerhead unit 14 by means of a fourth quick disconnect fitting 128. Partition 114 cooperates with ball member 92, previously described, to inhibit solid and liquid material from being sucked into vacuum motor 70.

Referring now to FIGS. 1–4, dispensing pump 52 is secured to a base member 130 having four apertures adjacent the respective four corners of base member 130. The apertures are adapted to receive respective rubber pins 132, which project upwardly from respective rubber mounting members 134, as can be best seen in FIG. 4. Each mounting member 134 is enlarged with respect to the corresponding pin 132 to define a corresponding support surface for supporting a bottom surface 130*a* of base member 130. Pins 132 extend through the respective apertures for locating base member 130 with respect to mounting members 134. Each mounting member 134 is secured to base plate 26 by means of a corresponding mounting bolt 136.

Figure 4:
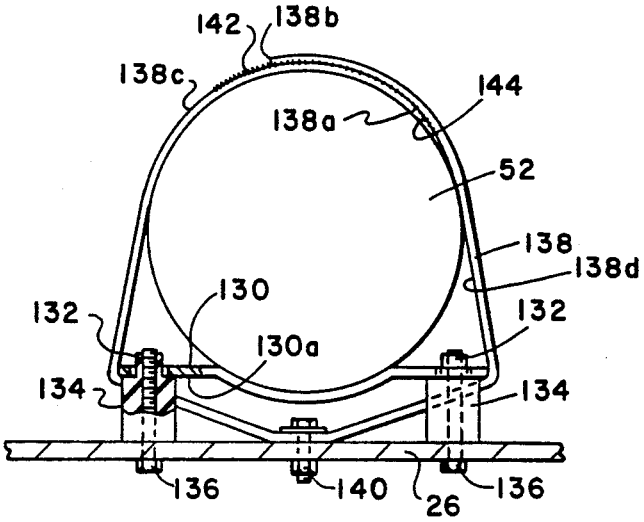
FIG. 4 is a sectional view, taken along the line 4—4 of FIG. 3.

A flexible strap 138 is bolted to base plate 26 by a bolt 140, at a location intermediate opposed ends 138*a* and 138*b* of strap 138 such that ends 138*a* and 138*b* are "free" ends. A plurality of hook fasteners 142, which are preferably of the type manufactured and sold by Velcro Corporation under the trademark "Velcro", are located on one major surface 138*c* of strap 138, adjacent end 138*a* thereof. A plurality of complementary loop fasteners 144, which are preferably of the type manufactured and sold by Velcro Corporation under the trademark "Velcro", are located on an opposite major surface 138*d* of strap 138, adjacent end 138*b* thereof. Ends 138*a* and 138*b* are adapted to be wrapped around dispensing pump 52 such that free end 138*b* overlaps end 138*a*, as shown in FIG. 4. Strap 138 is secured to itself by pressing the respective hook and loop fasteners 142 and 144 into engagement. Pins 132, mounting members 134 and strap 138 cooperate to absorb at least some of the vibration from pump 52.

When it is desired to remove pump 52 for maintenance or other purposes, end 138*b* is peeled back to disengage the respective hook and loop fasteners 142 and 144. Pump 52 and base member 130 can then be lifted off mounting members 134. Replacement of pump 52 is accomplished by repositioning base member 130 such that pins 132 are received within the respective apertures in base member 130 and bottom surface 130*a* rests on mounting members 134. Strap 138 is then reconnected, as previously described, to secure pump 52 in a relatively fixed position with respect to base plate 26.

Various embodiments of the invention have now been described in detail. Since it is obvious that many changes in and additions to the above-described preferred embodiment may be made without departing from the nature, spirit and scope of the invention, the invention is not to be limited to said details.

What is claimed is:

1. A cleaning apparatus, comprising, in combination:

a housing;

a first storage tank removably carried in said housing for storing a cleaning liquid, said first storage tank being positionable within said housing such that a portion extends above said housing;

dispensing means for dispensing cleaning liquid from said first storage tank to an area to be cleaned;

suction means for suctioning material from the area to be cleaned;

a second storage tank removably carried in said housing for accumulating material suctioned from the area to be cleaned, said second storage tank being positionable within said housing such that a portion of said second storage tank extends above said housing; and at least one of said first and second storage tanks having a cover member with opposed first and second structural members protruding therefrom and first and second handles attached to said at least one of said first and second storage tanks, said first and second structural members having respective first and second seating surfaces sloping downwardly and away from said cover member for urging the respective first and second handles into pressure engagement with the respective first and second structural members when said first and second handles are moved upwardly along the respective first and second seating surfaces, to retain said cover member in a closed position, said first and second handles being disengageable from the respective first and second structural members by moving said first and second handles downwardly along the respective first and second seating surfaces, to allow said cover member to be removed from said at least one of said first and second storage tanks.

2. Apparatus of claim 1 wherein said first and second storage tanks have respective first and second bottom recesses, said housing having first and second raised portions on a bottom surface thereof, said first and second raised portions being adapted to matingly engage the respective first and second recesses for locating the respective first and second storage tanks within said housing.

3. Apparatus of claim 2 further including a male member projecting upwardly from said housing and a female member depending downwardly from an external surface of said first storage tank, said female member being positioned in mating engagement with said male member when said first storage tank is located in said housing with said first raised portion in mating engagement with said first recess, a portion of said first storage tank extending above said housing when said male and female members are in mating engagement, said apparatus further including first conduit means located in said first storage tank and being coupled to said female member and second conduit means located outside said first storage tank and being coupled to said male member, the mating engagement between the male and female members effecting fluid communication between said first and second conduit means.

4. Apparatus of claim 3 wherein said dispensing means includes a pump for suctioning cleaning liquid from said first storage tank through said first and second conduit means and for discharging said cleaning liquid to be dispensed to said area.

5. Apparatus of claim 3 further including a locking ring for normally retaining said male and female members in mating engagement, said locking ring being manually operable for releasing said male member to be disengaged from said female member.

6. A cleaning apparatus, comprising, in combination:

a housing having first and second top openings, said housing having a removable cover plate adjacent said second top opening;

a first storage tank removably carried in said housing for storing a cleaning liquid, said first storage tank being removable from and insertable into said housing through said first top opening;

dispensing means for dispensing cleaning liquid from said first storage tank to an area to be cleaned;

suction means for suctioning material from the area to be cleaned, said suction means being mounted on a lower surface of said cover plate and said dispensing means being located below said cover plate such that said suction means and said dispensing means are accessible when said cover plate is removed; and a second storage tank removably carried in said housing for accumulating material suctioned from the area to be cleaned, said second storage tank being removable from and insertable into said housing through said second top opening.

7. A cleaning apparatus, comprising, in combination:

a housing;

first storage means removably carried in said housing for storing a cleaning liquid;

dispensing means for dispensing said cleaning liquid to an area to be cleaned, said dispensing means including a pump;

suction means for suctioning material from the area to be cleaned;

second storage means removably carried in said housing for accumulating material suctions from the area to be cleaned; and locating means for locating said pump in said housing, said locating means including a base member secured to said pump and a plurality of mounting members projecting upwardly from a bottom surface of said housing, said mounting members having respective pins defining respective top portions of said mounting members, said base member having a plurality of apertures adapted to receive the respective pins, respective lower portions of said mounting members being enlarged relative to the respective pins to define respective support surfaces for supporting said base member when said pins are received within the respective apertures.

8. Apparatus of claim 7 further including securing means for securing said pump in a fixed position in said housing, said securing means including a flexible strap attached to said bottom surface intermediate opposed first and second ends of said strap, said strap further including complementary first and second attachment members located adjacent the respective first and second ends, said strap being adapted to be wrapped around said pump and to be secured by the engagement of the first and second attachment members.

9. Apparatus of claim 8 wherein said first and second attachment members are complementary hook and loop fasteners, said hook fasteners being located on a first major surface of said strap adjacent said first end and said loop fasteners being located on a second major surface of said strap, opposite from said first major surface, adjacent said second end, one of said first and second ends being adapted to be secured in overlapping relationship with the other one of said first and second ends by the engagement of the hook and loop fasteners.

10. A cleaning apparatus, comprising, in combination:

a housing having a raised portion on a bottom surface thereof;

a first storage tank removably carried in said housing for storing a cleaning liquid, a portion of said first storage tank extending above said housing when said first storage tank is carried therein, said first storage tank having a bottom recess adapted for mating engagement with said raised portion for locating said first storage tank within said housing;

dispensing means for dispensing cleaning fluid from said first storage tank to an area to be cleaned;

suction means for suctioning material from the area to be cleaned;

a second storage tank removably carried in said housing for accumulating material suctioned from the area to be cleaned, a portion of said second storage tank extending above said housing when said second storage tank is carried therein; and a male member projecting upwardly from said housing and a female member depending downwardly from an external surface of said first storage tank, said female member being positioned in mating engagement with said male member when said first storage tank is positioned in said housing with said bottom recess in mating engagement with said raised portion, said apparatus further including first conduit means located in said first storage tank and being coupled to said first female member and second conduit means located outside said first storage tank and being coupled to said male member, the mating engagement between said male and female members effecting fluid communication between said first and second conduit means, whereby fluid is dispensable from said first storage tank.

11. Apparatus of claim 10 further including a locking ring for normally retaining said male and female members in mating engagement, said locking ring being manually operable for releasing said male member to be disengaged from said female member.

12. Apparatus of claim 10 wherein said suction means includes vacuum means for drawing air from said second storage tank to maintain a vacuum therein, said second storage tank having a partition for dividing an interior portion of said second storage tank into first and second chambers, said suction means being in fluid communication with said first chamber, said vacuum means being operable to draw material extracted from the area to be cleaned into said second chamber, said partition substantially inhibiting said material from penetrating into said first chamber and from being suctioned into said vacuum means.

13. Apparatus of claim 12 further including conduit means in fluid communication between said second storage tank and said vacuum means, said apparatus further including means for interrupting said fluid communication when a level of liquid within said second storage tank reaches a predetermined maximum level, said means for interrupting said fluid communication including a buoyant member adapted to substantially block said conduit means when said level of liquid reaches said predetermined maximum level, whereby the fluid communication between said vacuum means and said second storage tank is interrupted.

14. Apparatus of claim 13 further including filter means attached to a suction end of said conduit means within said second storage tank for substantially inhibiting the passage of solid material into said conduit means, said buoyant means including a ball member carried in said filter means, said ball member being located in a bottom portion of said filter means when the level of liquid in said second storage tank is below said bottom portion of said filter means, said ball member being supported by the liquid in said second storage tank when the level of liquid in said second storage tank is above the bottom portion of said filter means, said ball member being adapted to substantially the block said conduit means when said level of liquid reaches said predetermined maximum level.

15. A cleaning apparatus, comprising, in combination:

a housing;

first storage means removably carried in said housing for storing a cleaning liquid;

dispensing means for dispensing cleaning liquid from said first storage means to an area to be cleaned;

suction means for suctioning material from the area to be cleaned;

second storage means removably carried in said housing for accumulating material suctioned from the area to be cleaned, said suction means including vacuum means for sucking air from said second storage means to maintain a vacuum therein, said vacuum means being operable to suction excess cleaning liquid and other material extracted from the area to be cleaned into said second storage means;

a duct for discharging air suctioned from said second storage means to the area to be cleaned exterior to said housing, the air discharged through said duct being heated by said vacuum means to a temperature greater than the temperature of the air in said second storage means; and swivelable means for mounting said duct on a bottom portion of said housing for swiveling movement to allow the direction in which air is discharged through said duct to be changed.

* * * * *